United States Patent [19]

Varano

[11] Patent Number: 4,520,349

[45] Date of Patent: May 28, 1985

[54] ALARM SYSTEM ACTIVATED BY BUZZERS

[76] Inventor: Vincent Varano, 5816 Claude St., Montreal North, Quebec, Canada, H1G 1V2

[21] Appl. No.: 367,547

[22] Filed: Apr. 12, 1982

[30] Foreign Application Priority Data

Apr. 24, 1981 [CA] Canada ..... 376178

[51] Int. Cl.[3] ..... G08B 13/00; G08B 25/00

[52] U.S. Cl. ..... 340/531; 340/541

[58] Field of Search ..... 340/531, 541

[56] References Cited

U.S. PATENT DOCUMENTS

| | | | |
|---|---|---|---|
| 3,725,892 | 4/1973 | Faltico | 340/541 |
| 3,838,408 | 9/1974 | McMaster | 340/541 X |
| 3,973,250 | 8/1976 | Uffelman | 340/531 |
| 4,001,805 | 1/1977 | Golbe | 340/531 X |
| 4,160,972 | 7/1979 | La Mell et al. | 340/541 |
| 4,191,943 | 3/1980 | Bouchard et al. | 340/531 |
| 4,207,559 | 6/1980 | Meyer | 340/531 |
| 4,309,698 | 1/1982 | Lecuyer et al. | 340/531 X |
| 4,417,235 | 11/1983 | Del Grande | 340/531 |
| 4,446,454 | 5/1984 | Pyle | 340/531 X |

FOREIGN PATENT DOCUMENTS

| | | | |
|---|---|---|---|
| 2437341 | 2/1976 | Fed. Rep. of Germany | 340/531 |
| 51896 | 4/1977 | Japan | 340/531 |

*Primary Examiner*—Stephen A. Kreitman
*Assistant Examiner*—Tom Noland

[57] ABSTRACT

In alarm systems a central control unit has been activated by sensors at the entrances of a home. The sensors signal the central control unit through extensive wiring or by a radio transmitter at each entrance. In this invention the signalling is done by an inexpensive buzzer at each entrance providing a definite distinct sound to be identified. The central control unit in this invention is sensitive to be activated by the buzzer of a distant entrance but it is not activated by ordinary sounds in an unoccupied home.

4 Claims, 3 Drawing Figures

ALARM SYSTEM ACTIVATED BY BUZZERS

FIELD OF INVENTION

This invention relates to an alarm system activated from the entrances of a home.

DISCUSSION OF PRIOR ART

Heretofore, in alarm systems activated from the entrances, sensors at the entrances have been connected to a central control unit with wires in the walls. This system is time-consuming and expensive to install because of the extensive wiring. Wireless systems have appeared whereby a signal from the sensors at the entrances is transmitted to a central control unit by means of radio waves. This system is relatively expensive requiring a radio transmitter at each entrance.

Heretofore, circuits have been available which are activated by sound. Some circuits distinguish between different sounds by selective frequencies, and lately an alarm system has been sold described as having a small computer to pick-up break-in type noises such as breaking glass, prying metal, or forcing a door open. With such alarms, an intruder has to commit a sound and the circuit has to distinguish between a variety of sounds, including those occurring in an unoccupied home. My invention overcomes seemingly conflicting requirements, namely, how to use the complex sound medium for intrusion detection without using these prior relatively complex means.

OBJECTS OF INVENTION

Accordingly several objects of my invention are a buzzer purposefully placed at each entrance to provide a definite distinct sound which activates a central control unit designed to identify said buzzer sound and switch-on a siren. The central control unit is sensitive to pick-up the sound produced by the buzzer at a distant entrance, but it is not activated by ordinary sounds in an unoccupied home. The buzzer sound is distinguished by its loudness and its persistence, and the simplest and inexpensive of buzzers will suffice, without requiring one particular and stable frequency for all buzzers. The central control unit is also inexpensive. An added advantage of this invention is that when the home is occupied and the central control unit is turned off, an intruder will still activate the buzzer at an entrance and hence the occupant is warned of an intruder and from which area of the home. Further objects and advantages of this invention will become apparent from a consideration of the drawings and ensuing description thereof.

BRIEF DESCRIPTION OF DRAWINGS

In drawings which illustrate embodiments of this invention.

DESCRIPTION OF INVENTION

Figure 1:
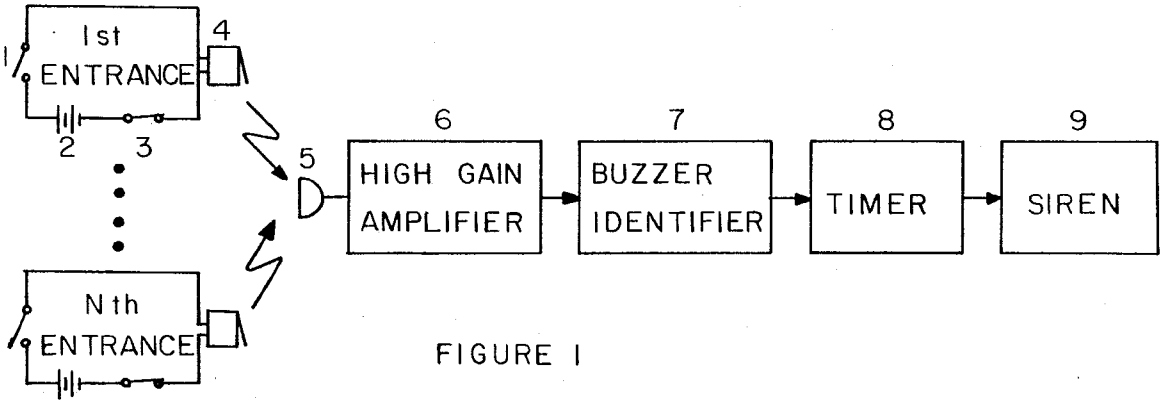
FIG. 1 is a block diagram of the alarm system.

In FIG. 1, when an intruder opens an entrance, a sensor switch 1 applies battery 2 to a buzzer 4 which makes a one type of loud persistent sound irrespective of which entrance. Switch 3 is used when the occupant wants to open the entrance and not activate the alarm.

The microphone 5 of the central control unit picks up the sound and converts the sound into electrical signal and it is amplified by a high-gain amplifier 6. Subsequently a buzzer identifier 7 reacts positively to the one type of sound of the buzzer, without identifying the particular buzzer, and a timer 8 switches-on an alerting siren 9, bell, or horn.

Figure 2:
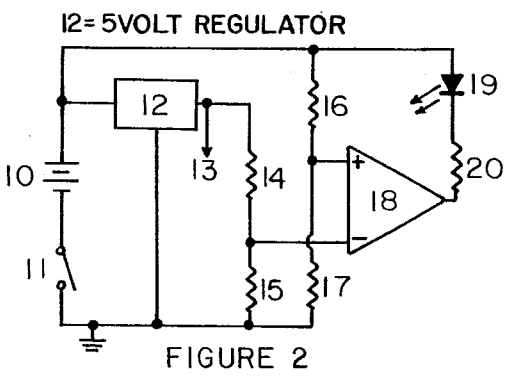
FIG. 2 is the schematic diagram of the power supply circuit in the central control unit.

In FIG. 2, a nine volt battery 10 is regulated down to five volts at point 13. The circuit around comparator 18 is used to test for the condition of the nine volt battery.

Figure 3:
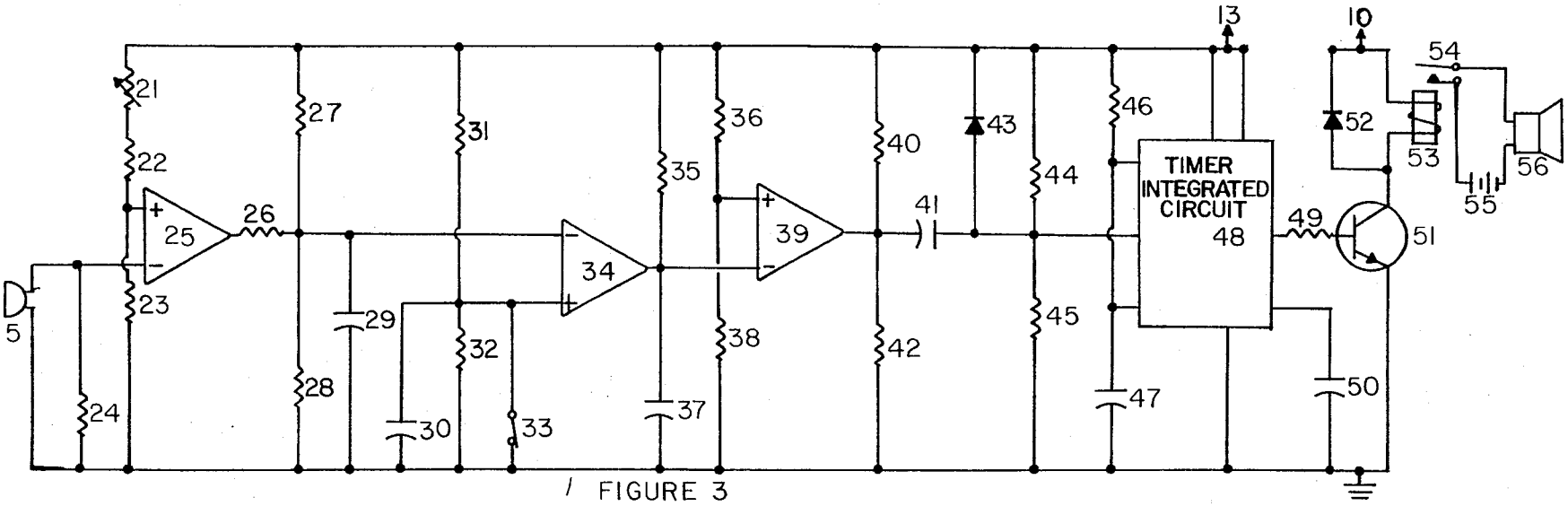
FIG. 3 is the schematic diagram of the main circuit in the central control unit.

In FIG. 3, the high-gain amplification is achieved by the comparator 25 which converts the small analog voltage signal from the microphone 5 to a pulse sequence signal at the output of comparator 25.

In FIG. 3, the buzzer identifier has capacitor 29 and comparator 34. Capacitor 29 is charged when the power is turned on. When a buzzer is activated, the pulse sequence signal from comparator 25 discharges capacitor 29. When capacitor 29 is discharged to the threshold of comparator 34, the output of comparator 34 switches from low to high. Comparator 39 prevents false activations at the moment power is turned on.

Capacitor 29 is discharged a small amount by one pulse from comparator 25 and thus the sound input must be loud and persistent as that produced by a buzzer in order for capacitor 29 to be discharged to the threshold level. Many closely occurring pulses as that produced by the buzzer are required. As a result of the buzzer identifier, a buzzer at a distant entrance to a home or premise activates the alarm, yet a ringing telephone does not, provided that the telephone volume is adjusted to low and the central control unit is not located within a few feet from the telephone.

In FIG. 3, the timer consists of a trigger network around capacitor 41 and a timer integrated circuit 48. When a buzzer is activated, the output of comparator 39 switches from high to low and the network around capacitor 41 produces a negative-going pulse. This pulse triggers the timer which turns on a relay 53 for a set time of several minutes. The contacts of relay 54 apply battery 55 to a siren, bell, or horn 56.

Resistors 21,22,23 set the threshold for comparator 25. Resistor 21 is adjustable for sensitivity. Resistor 24 pulls the negative input of comparator 25 to ground. Capacitor 29 is charged to the level determined by resistors 27,28 and is discharged by the open-collector output transistor of comparator 25 through resistor 26.

Capacitor 30 makes the threshold of comparator 34 charge slower than the charging of capacitor 29 when the power is turned on. Resistor 35 and capacitor 37 delay the switch from low to high of comparator 39 required at the moment when power is turned on. The contact 33 of the power switch is closed when the power is Off and contact 33 discharges capacitor 30 quickly when power is turned off and prevents false operation should the power be immediately turned on again. Resistors 36,38 provide the threshold for comparator 39.

Resistors 40,42,44,45 bias the two ends of capacitor 41 close to five volts. When the output of comparator 39 drops to zero, capacitor 41 differentiates it and provides a negative-going pulse which triggers the timer 48. Diode 43 prevents a voltage rise over five volts. Resistor 46 and capacitors 47,50 are the components for the timer to give a pulse of several minutes. This pulse turns on transistor 51 through resistor 49 and the relay 53 is operated.

The divider formed by resistors 14,15 provide a constant voltage at the negative input of comparator 18. The divider formed by resistors 16,17 provide a voltage to the positive input of comparator 18 which depends on the voltage of the power battery 10. When this voltage drops because the battery is weak, the output of comparator 18 drops to zero and the light emitting diode 19 turns on through resistor 20. Component 12 is a five volt regulator.

A set of component values are given in brackets following the component number. The values are in Megohm for resistors and in microfarad for capacitors: 21(0.8), 22(2.7), 23(0.001), 24(0.1), 26(1), 27(1), 28(1), 29(1.5), 30(2.2), 31(1.4), 32(1), 35(0.1), 36(1.5), 37(0.1), 38(1), 40(0.01), 41(0.001), 42(0.1), 44(0.01), 45(0.1), 46(1), 47(250), 50(0.01), 14(1.5), 15(1), 16(2.5), 17(1), 20(0.001), ceramic microphone, LM339 comparators, 555 timer.

While the above description contains many specifics, other variations are possible and examples are as follows. The buzzers can be electromechanical, solid state, or gaseous cartridges. The buzzer identifier in the central control unit may have a tone decoder integrated circuit. The sensor switch at the entrances can be a normally-closed type by having an SCR with the buzzer. The timer and the battery test circuits are optional. This alarm system can be used in other areas such as appartments and offices. Where the area to be protected is large or on different floors, more than one central control unit can be used. This invention is intended to embrace any such variations within the scope determined by the appended claims.

What is claimed is:

1. An alarm system to be activated by an intruder at any protected entrance of a premise having a plurality of protected entrances and producing an alarm sound at the intruded upon protected entrance and subsequently an alarm sound at a central location in the premise, wherein:

each protected entrance has a sensor switch attached thereto, the sensor switch attached to any intruded upon protected entrance being switched by the entrance of the intruder threat, each protected entrance having a buzzer thereat, the buzzer at any intruded upon protected entrance activated with power from a battery switched by the sensor switch attached to the intruded upon protected entrance, whereby the buzzer associated with the intruded upon entrance is activated and emits said alarm sound at the intruded upon protected entrance, the sound produced by different buzzers in the alarm system being substantially identical, and wherein said alarm system further comprises;

a microphone proximate said central location to receive sound from any activated buzzer and convert said sound into a varying electrical signal, a front-end comparator means whereby said varying electrical signal is compared to a threshold level, simultaneously amplified when beyond said threshold level, and converted to a pulse sequence signal of two states as given by the output of said comparator means, a capacitor means post said front-end comparator means whereby charging of said capacitor means is altered by said pulse sequence signal, and a comparator means post said capacitor means whereby an alarm at said central location is activated when the charging of said capacitor means reaches a voltage threshold level.

2. An alarm system according to claim 1, wherein even when an activated buzzer is more than a few feet distant from said microphone the sound therefrom will still activate the alarm at said central location.

3. An alarm system as defined in claim 1, where said comparator means comprise integrated circuits.

4. An alarm system as defined in claim 1, where said comparator means comprise operational amplifiers.

* * * * *